US007026583B2

(12) United States Patent
Tu et al.

(10) Patent No.: US 7,026,583 B2
(45) Date of Patent: Apr. 11, 2006

(54) SURFACE MOUNTABLE PTC DEVICE

(75) Inventors: Ching-Fang Tu, Kaohsiung (TW); Fu-Sen Liao, Kaohsiung (TW); Hsueh-Huan Lo, Kaohsiung Hsien (TW)

(73) Assignee: China Steel Corporation

( * ) Notice: Subject to any disclaimer, the term of this patent is extended or adjusted under 35 U.S.C. 154(b) by 0 days.

(21) Appl. No.: 10/818,243

(22) Filed: Apr. 5, 2004

(65) Prior Publication Data

US 2005/0236397 A1 Oct. 27, 2005

(51) Int. Cl.
*H05B 3/08* (2006.01)

(52) U.S. Cl. ..... 219/541; 219/505; 219/544; 219/548; 338/22 R; 338/328

(58) Field of Classification Search ..... 219/505, 219/541, 544, 546, 548; 338/325, 327, 322, 338/328, 338, 22 R
See application file for complete search history.

(56) References Cited

U.S. PATENT DOCUMENTS 4,743,321 A * 5/1988 Soni et al. ..... 156/85
4,992,771 A * 2/1991 Caporali et al. ..... 338/22 R
5,852,397 A * 12/1998 Chan et al. ..... 338/22 R
5,864,281 A * 1/1999 Zhang et al. ..... 338/22 R
6,020,808 A * 2/2000 Hogge ..... 338/22 R
6,124,781 A * 9/2000 Hogge et al. ..... 338/22 R
6,211,771 B1 * 4/2001 Zhang et al. ..... 338/22 R
6,242,997 B1 * 6/2001 Barrett et al. ..... 338/22 R
6,686,827 B1 * 2/2004 Chen et al. ..... 338/22 R
6,809,626 B1 * 10/2004 Chu et al. ..... 337/167

* cited by examiner

*Primary Examiner*—Robin O. Evans
*Assistant Examiner*—Leonid M. Fastovsky
(74) *Attorney, Agent, or Firm*—Kenneth C. Brooks

(57) ABSTRACT

A surface mountable PTC device includes a PTC layer, first and second electrodes formed on the PTC layer, first and second insulating layers formed respectively on the first and second electrodes, and first and second terminals connected respectively and electrically to the first and second electrodes. Each of the first and second electrodes is formed with a hole. Each of the first and second insulating layers fills the electrode hole in the respective one of the first and second electrodes and is formed with an insulating hole surrounded by the electrode hole. Each of the first and second terminals extends through the insulating hole in the respective one of the first and second insulating layers.

2 Claims, 6 Drawing Sheets

SURFACE MOUNTABLE PTC DEVICE

BACKGROUND OF THE INVENTION

1. Field of the Invention

This invention relates to a surface mountable PTC device, more particularly to a surface mountable PTC device suitable for high current applications.

2. Description of the Related Art

FIG. 1 illustrates a conventional surface mountable PTC (Positive Temperature Coefficient) device 1 that is disclosed in U.S. Pat. No. 5,852,397. The PTC device 1 includes a PTC layer 10 of a PTC material, first and second metal foils 11 formed on two opposite surfaces of the PTC layer 10, and first and second terminals 13 extending through the first and second metal foils 11 and the PTC layer 10 so as to contact electrically the first and second metal foils 11. A portion of each of the first and second metal foils 11 is removed by etching so as to divide each of the first and second metal foils 11 into two separate parts and so as to form first and second electrodes 121, 122, which are respectively and electrically connected to the first and second terminals 13, on each surface of the PTC layer 10. The aforesaid PTC device 1 is disadvantageous in that a substantial portion of each metal foil 11 is removed, which results in a significant decrease in the current passing through the PTC device 1. As a consequence, the size of the PTC device 1 is required to be increased for high current applications, which is against the trend toward minimization of the PTC device 1.

FIG. 2 illustrates another conventional PTC device 3 that is prepared by attaching first and second metal foils 31 to two opposite sides of a PTC layer 30, removing an end portion of each metal foil 31 so as to form two recesses in two opposite ends of the PTC device 3 and so as to form first and second electrodes 311, 312 respectively on the sides of the PTC layer 30, forming two insulating layers 32 respectively on the first and second electrodes 311, 312 in such a manner that each insulating layer 32 fills a respective one of the recesses, forming two holes in the ends of the PTC device 3, and forming first and second terminals 351, 352 respectively in the holes in such a manner that the first terminal 351 is electrically connected to the second electrode 312 and that the second terminal 352 is electrically connected to the first electrode 311. The aforesaid PTC device 3 is disadvantageous in that in order to isolate the first electrode 311 from the first terminal 351 and the second electrode 312 from the second terminal 352, an entire end portion of each of the first and second metal foils 31 is removed, which results in a decrease in the areas of the first and second electrodes 311, 312, which, in turn, results in a reduction in the current passing through the PTC device 3.

SUMMARY OF THE INVENTION

Therefore, the object of the present invention is to provide a surface mountable PTC device that is capable of overcoming the aforementioned drawback associated with the prior art.

According to the present invention, there is provided a surface mountable PTC device that comprises: a device body having two opposite first sides and two opposite second sides, each of which is transverse to and interconnects the first sides. The device body includes: a PTC layer that extends from one of the first sides to the other of the first sides, that further extends from one of the second sides to the other of the second sides, that has two opposite surfaces, and that is formed with a left PTC hole extending from one of the surfaces to the other of the surfaces; opposite first and second electrodes that are respectively formed on the surfaces of the PTC layer, that extend from one of the first sides to the other of the first sides, and that further extend from one of the second sides to the other of the second sides, the first electrode being formed with a left electrode hole that is aligned and that is in spatial communication with the left PTC hole, and a right electrode hole that is spaced apart from the left electrode hole, the second electrode being formed with a left electrode hole that is aligned and that is in spatial communication with the left PTC hole; opposite first and second insulating layers that are respectively formed on the first and second electrodes, that extend from one of the first sides to the other of the first sides, and that further extend from one of the second sides to the other of the second sides, the first insulating layer filling the left electrode hole in the first electrode, and being formed with a left insulating hole that is aligned and that is in spatial communication with the left PTC hole, and a right insulating hole that is aligned and that is in spatial communication with the right electrode hole in the first electrode; a first terminal extending into and through the left insulating hole and the left PTC hole and further extending into the left electrode hole in the second electrode so as to contact electrically the second electrode, the first terminal having an upper contact portion that is formed on the first insulating layer around a periphery of the left insulating hole; and a second terminal extending into and through the right insulating hole in the first insulating layer and further extending into the right electrode hole in the first electrode so as to contact electrically the first electrode, the second terminal having an upper contact portion that is formed on the first insulating layer around a periphery of the right insulating hole.

BRIEF DESCRIPTION OF THE DRAWINGS

In drawings which illustrate embodiments of the invention.

DETAILED DESCRIPTION OF THE PREFERRED EMBODIMENTS

Figure 1:
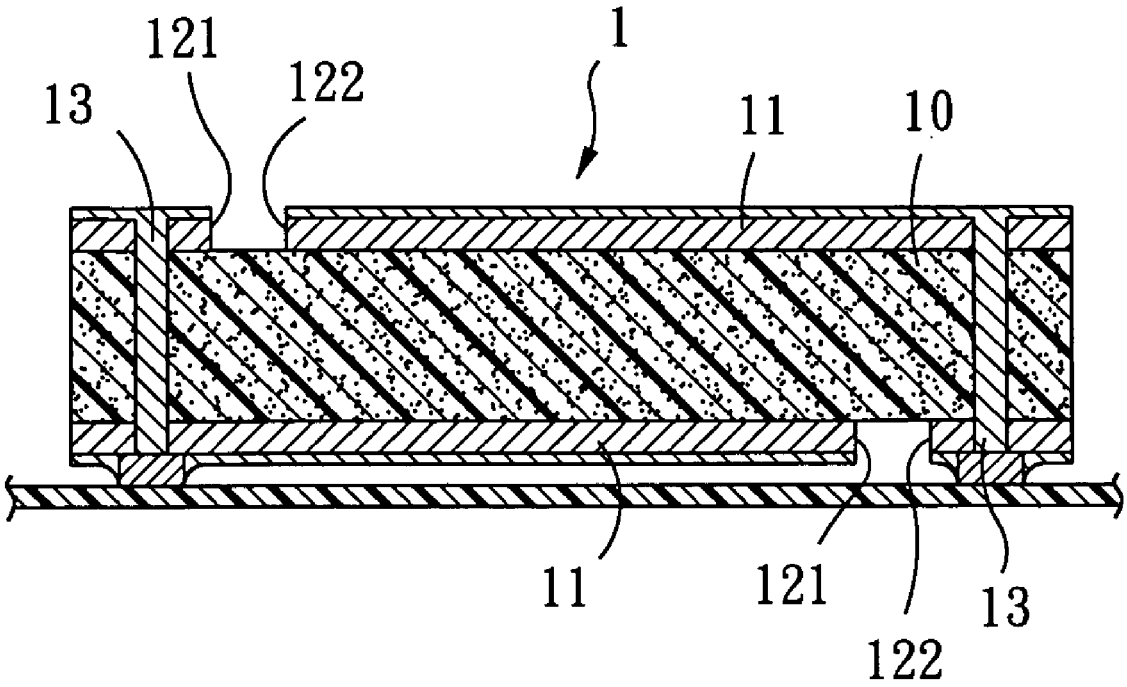
FIG. 1 PRIOR ART
FIG. 1 is a sectional view of a conventional surface mountable PTC device.
Figure 2:
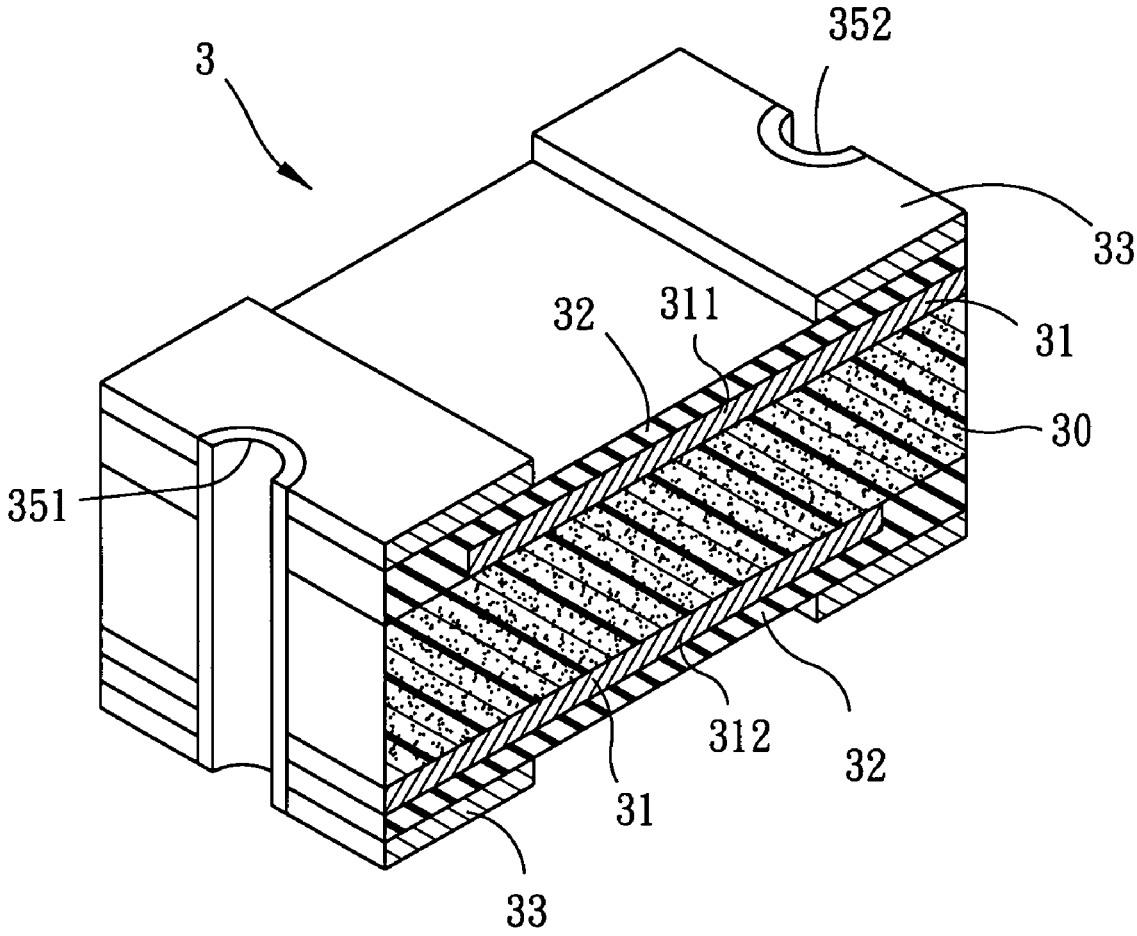
FIG. 2 PRIOR ART
FIG. 2 is a sectioned perspective view of another conventional surface mountable PTC device.

For the sake of brevity, same reference numerals are used to denote similar elements throughout the specification.

Figure 3:
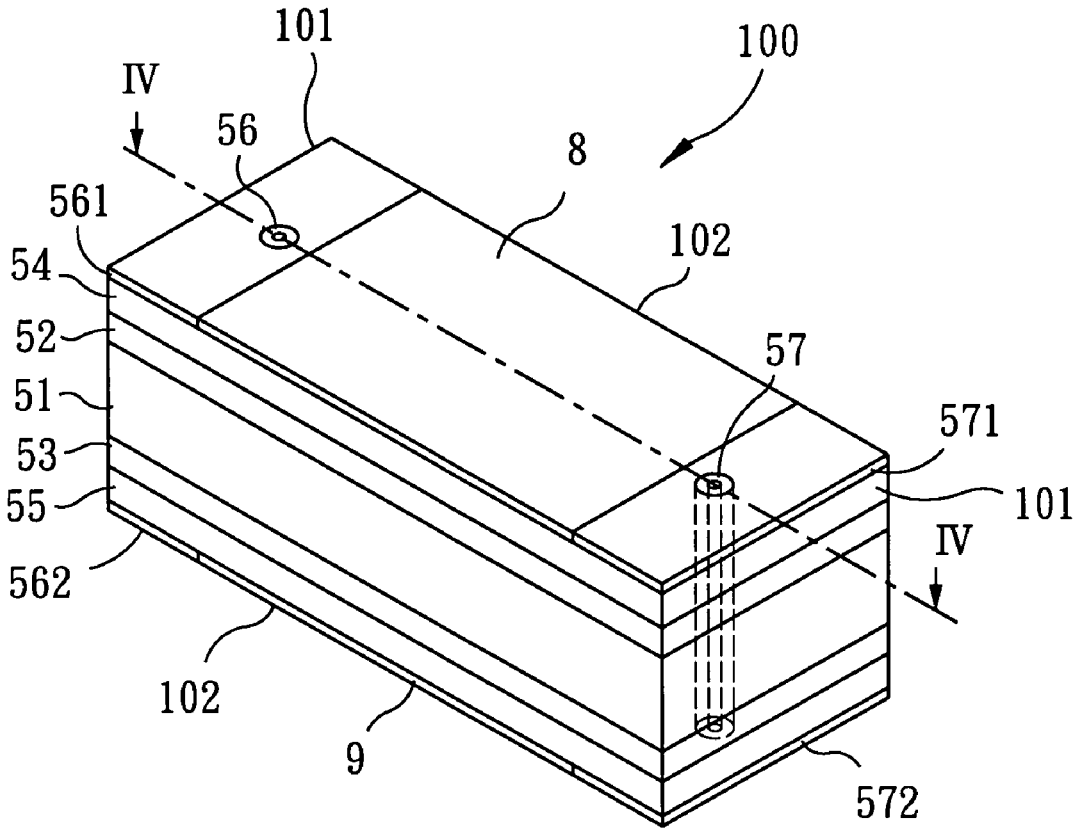
FIG. 3 is a sectioned perspective view of the first preferred embodiment of a surface mountable PTC device according to this invention.
Figure 4:
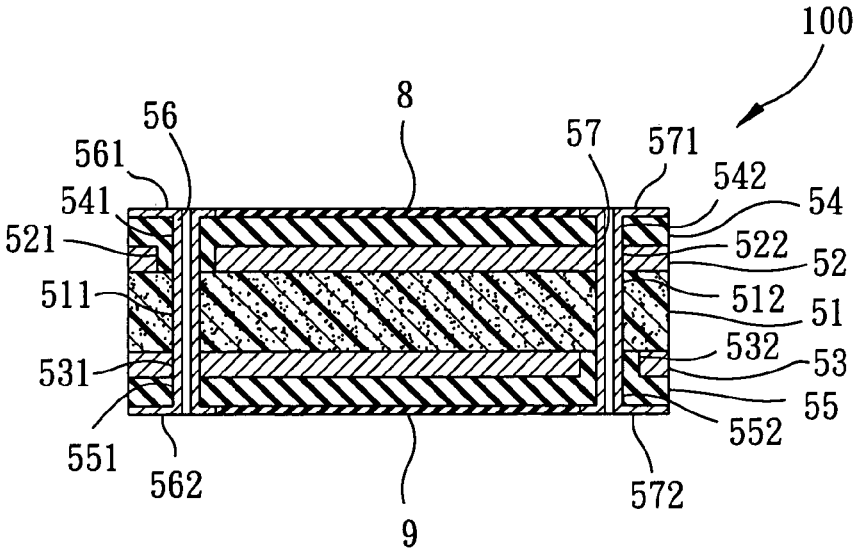
FIG. 4 is a sectional view of the first preferred embodiment, taken along line IV—IV in FIG. 3.

FIGS. 3 and 4 illustrate the first embodiment of a surface mountable PTC device according to this invention. The surface mountable PTC device includes: a device body 100 having two opposite first sides 101 and two opposite second sides 102, each of which is transverse to and interconnects the first sides 101. The device body 100 includes a PTC layer 51 that extends from one of the first sides 101 to the other of the first sides 101, that further extends from one of the second sides 102 to the other of the second sides 102, that has two opposite surfaces, and that is formed with a left PTC hole 511 extending from one of the surfaces to the other of the surfaces of the PTC layer 51; opposite first and second electrodes 52, 53 that are respectively formed on the surfaces of the PTC layer 51, that extend from one of the first sides 101 to the other of the first sides 101 of the device body 100, and that further extend from one of the second sides 102 to the other of the second sides 102 of the device body 100, the first electrode 52 being formed with a left electrode hole 521 that is aligned and that is in spatial communication with the left PTC hole 511, and a right electrode hole 522 that is spaced apart from the left electrode hole 521, the second electrode 53 being formed with a left electrode hole 531 that is aligned and that is in spatial communication with the left PTC hole 511; opposite first and second insulating layers 54, 55 that are respectively formed on the first and second electrodes 52, 53, that extend from one of the first sides 101 to the other of the first sides 101 of the device body 100, and that further extend from one of the second sides 102 to the other of the second sides 102 of the device body 100, the first insulating layer 54 filling the left electrode hole 521 in the first electrode 52, and being formed with a left insulating hole 541 that is surrounded by the left electrode hole 521 in the first electrode 52 and that is aligned and that is in spatial communication with the left PTC hole 511, and a right insulating hole 542 that is aligned and that is in spatial communication with the right electrode hole 522 in the first electrode 52; a first terminal 56 extending into and through the left insulating hole 541 and the left PTC hole 511 and further extending into the left electrode hole 531 in the second electrode 53 so as to contact electrically the second electrode 53, the first terminal 56 having an upper contact portion 561 that is formed on the first insulating layer 54 around a periphery of the left insulating hole 521; and a second terminal 57 extending into and through the right insulating hole 542 in the first insulating layer 54 and further extending into the right electrode hole 522 in the first electrode 52 so as to contact electrically the first electrode 52, the second terminal 57 having an upper contact portion 571 that is formed on the first insulating layer 54 around a periphery of the right insulating hole 542. The PTC layer 51 is further formed with a right PTC hole 512 that is spaced apart from the left PTC hole 511 and that extends from one of the surfaces to the other of the surfaces of the PTC layer 51. The second electrode 53 is formed with a right electrode hole 532 that is aligned and that is in spatial communication with the right PTC hole 512. The second insulating layer 55 fills the right electrode hole 532 in the second electrode 53, and is formed with a left insulating hole 551 that is aligned and that is in spatial communication with the left electrode hole 531 in the second electrode 53, and a right insulating hole 552 that is surrounded by the right electrode hole 53 in the second electrode 53 and that is aligned and that is in spatial communication with the right PTC hole 512. The second terminal 57 extends into and through the right insulating hole 552 in the second insulating layer 55 and the right PTC hole 512, and further has a lower contact portion 572 that is formed on the second insulating layer 55 around a periphery of the right insulating hole 552 in the second insulating layer 55. The first terminal 56 extends through the left electrode hole 531 in the second electrode 53 and the left insulating hole 551 in the second insulating layer 55, and further has a lower contact portion 562 that is formed on the second insulating layer 55 around a periphery of the left insulating hole 551 in the second insulating layer 55.

In this embodiment, a first protective layer 8 is formed on the first insulating layer 54, and extends between the upper contact potions 561, 571 of the first and second terminals 56, 57. A lower protective layer 9 is formed on the second insulating layer 55, and extends between the lower contact portions 562, 572 of the first and second terminals 56, 57.

Preferably, the PTC material has a composition containing a polymer mixture of polyolefin, such as polyethylene and polypropylene, and copolymer of the polyolefin, and conductive particulate, such as metal particulate and carbon black particulate.

Preferably, the first and second insulating layers 54, 55 are made from a mixture of epoxy resin and glass fibers. The first and second protective layers 8, 9 are preferably made from an anti-welding coating material.

FIGS. 5A to 5E illustrate consecutive steps of a method for making the surface mountable PTC device of the first embodiment of this invention. The method includes the steps of: laminating first and second metal foils 52', 53' to the surfaces of the PTC layer 51 under a temperature ranging from 180–230° C. and a pressure ranging from 80–50 kg/cm$^2$ (see FIG. 5A); forming the left electrode hole 521 in the first metal foil 52' and the right electrode hole 532 in the second metal foil 53' so as to form the first and second electrodes 52, 53 on the PTC layer 51 (see FIG. 5B) forming the first and second insulating layers 54, 55 respectively on the first and second electrodes 52, 53 to form a semi-product in which the first and second insulating layers 54, 55 respectively fill the left electrode hole 521 in the first metal foil 52' and the right electrode hole 532 in the second metal foil 53' (see FIG. 5C); drilling the semi-product in such a manner to form the left and right PTC holes 511, 512, the right electrode hole 522 in the first electrode 52, the left electrode hole 531 in the second electrode 53, the left and right insulating holes 541, 542 in the first insulating layer 54, and the left and right insulating holes 551, 552 in the second insulating layer 55 (see FIG. 5D); and forming the first and second terminals 56, 57 by electroless plating. Each of the first and second terminals 56, 57 can be formed by first plating a copper film, followed by plating a tin-lead alloy film thereon.

The diameter of each of the right electrode hole 522 of the first electrode 52 and the left electrode hole 531 of the second electrode 53 can be as small as 0.3 mm when using mechanical drilling techniques, 0.123 mm when using $CO_2$ laser drilling techniques, and 0.04 mm when using UV laser drilling techniques. As a consequence, the area of each of the first and second electrodes 52, 53 that covers the respective surface of the PTC layer 51 can be maximized.

Figure 6:
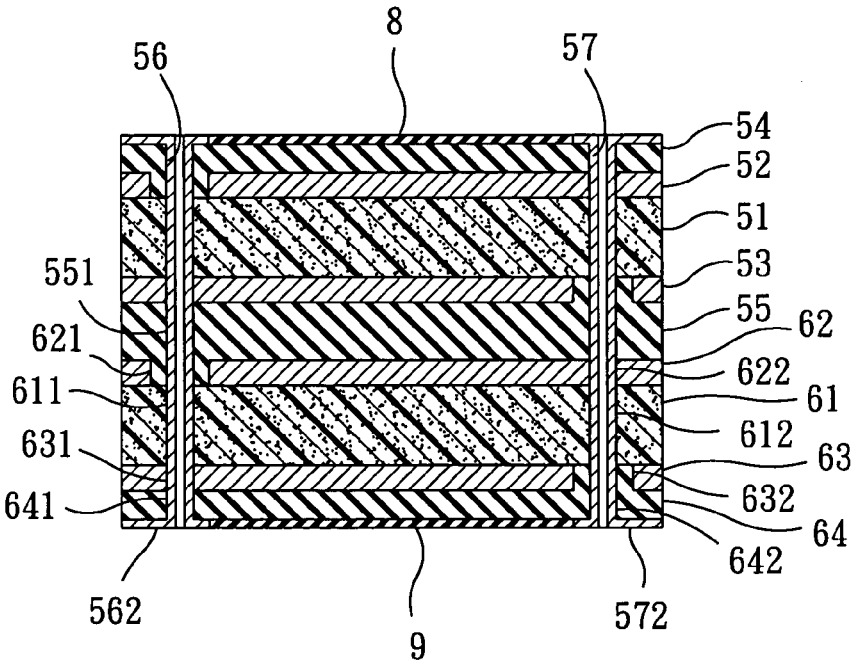
FIG. 6 is a sectional view of the second preferred embodiment of the surface mountable PTC device according to the present invention.
Figure 5A:
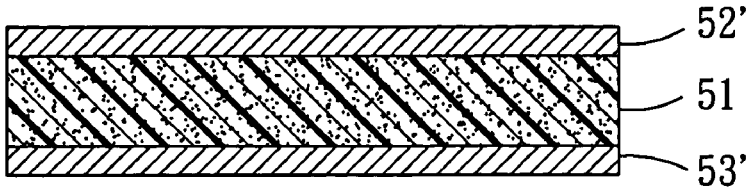
FIGS. 5A to 5E are sectional views to illustrate consecutive steps of a method for making the surface mountable PTC device of the first embodiment according to the present invention.
Figure 5B:
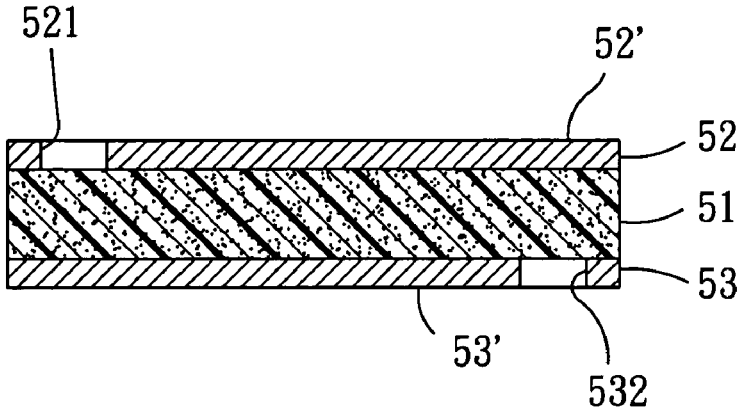
Figure 5C:
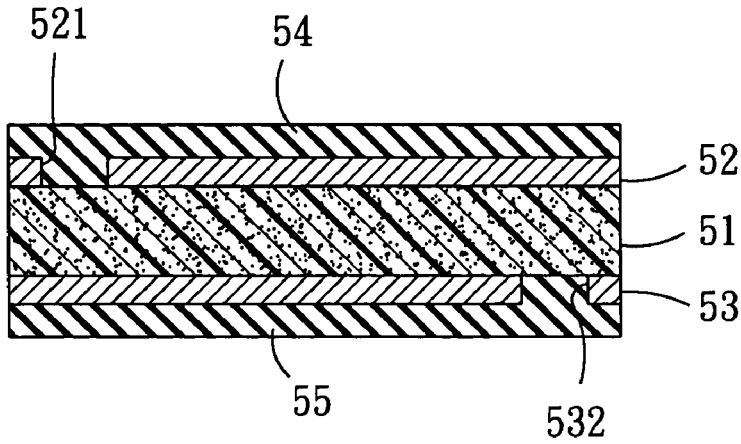
Figure 5D:
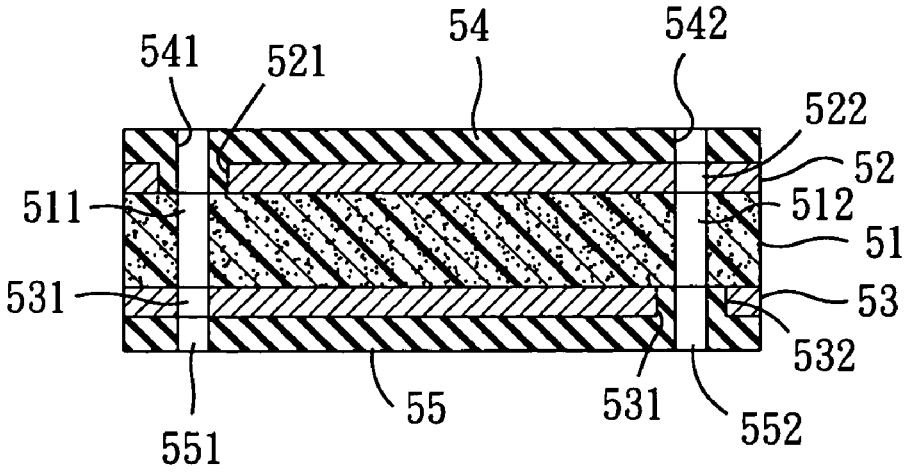
Figure 5E:
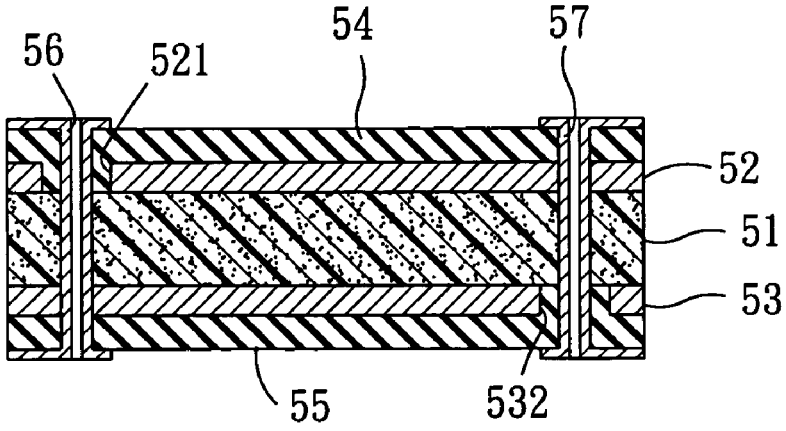

FIG. 6 illustrates the second preferred embodiment of the surface mountable PTC device according to this invention. The surface mountable PTC device of this embodiment includes two superimposed PTC units, each of which is similar to the device body 100 of the previous embodiment. In addition to the aforesaid PTC layer 51, the first and second electrodes 52, 53, and the first and second insulating layers 54, 55, the surface mountable PTC device of this embodiment further includes: a third electrode 62 that is formed on an opposite side of the second insulating layer 55 opposite to the second electrode 53 and that is formed with left and right electrode holes 621, 622; a second PTC layer 61 that is formed on an opposite side of the third electrode 62 opposite to the second insulating layer 55 and that is formed with left and right PTC holes 611, 612; a fourth electrode 63 that is formed on an opposite side of the PTC layer 61 opposite to the third electrode 62 and that is formed with left and right electrode holes 631, 632; and a third insulating layer 64 that is formed on an opposite side of the fourth electrode 63 opposite to the second PTC layer 61, that fills the right electrode hole 632 in the fourth electrode 63, and that is formed with left and right insulating holes 641, 642. The second insulating layer 55 fills the left electrode hole 621 in the third electrode 62. The left insulating hole 551 in the second insulating layer 55 is aligned and is in spatial communication with the left PTC hole 611 in the second PTC layer 61. The left insulating hole 641 in the third insulating layer 64 is aligned and is in spatial communication with the left electrode hole 631 in the fourth electrode 63. The right insulating hole 642 in the third insulating layer 64 is aligned and is in spatial communication with the right PTC hole 612 in the second PTC layer 61. The first terminal 56 further extends through the left PTC hole 611 in the second PTC layer 61, the left electrode hole 631 in the fourth electrode 63, and the left insulating hole 641 in the third insulating layer 64 so as to contact electrically the fourth electrode 63. The second terminal 57 further extends through the right electrode hole 622 in the third electrode 62, the right PTC hole 612 in the second PTC layer 61, and the right insulating hole 642 in the third insulating layer 64 so as to contact electrically the third electrode 62. In this embodiment, the lower contact portion 562 of the first terminal 56 is formed on the third insulating layer 64 around a periphery of the left insulating hole 641 in the third insulating layer 64. The lower contact portion 572 of the second terminal 57 is formed on the third insulating layer 64 around a periphery of the right insulating hole 642 in the third insulating layer 64. Moreover, the second protective layer 9 is formed on the third insulating layer 64 between the lower contact portions 562, 572 of the first and second terminals 56, 57.

By forming the left electrode hole 521 in the first electrode 52 and the right electrode hole 532 in the second electrode 53, the area of each of the first and second electrodes 52, 53 that covers the respective surface of the PTC layer 51 can be maximized, which, in turn, results in a higher current passing through the PTC device as compared to the aforementioned conventional PTC device.

With the invention thus explained, it is apparent that various modifications and variations can be made without departing from the spirit of the present invention. It is therefore intended that the invention be limited only as recited in the appended claims.

We claim:

1. A PTC device comprising:

a first electrode including a first aperture;

a second electrode including a second aperture;

a body of PTC material disposed between said first and second electrodes and having first and second opposed surface;

a first insulative layer having a first side and a projection, disposed opposite to said first side and extending into said first aperture and terminating proximate to said first surface;

a second insulative layer having a second side and a protrusion extending into said second aperture and terminating proximate to said second surface; and first and second terminals, each of which extends between opposed contact portions, with said first side being disposed between with one of said contact portions associated with said first terminal and said second side being disposed between said with one of said contact portions associated with said second and said second surface, wherein said projection surrounds a portion of said first terminal and said protrusion surrounds a region of said second terminal.

2. The PTC device as recited in claim 1 wherein said projection and said protrusion each has an annular shape.

* * * * *